US005878554A

United States Patent [19]

Loree et al.

[11] Patent Number: 5,878,554

[45] Date of Patent: Mar. 9, 1999

[54] EFFICIENT SHEET STACK PACKAGING TECHNIQUE

[75] Inventors: Dale E. Loree, Laguna Niguel; Anthony J. Grace, Long Beach, both of Calif.

[73] Assignee: Avery Dennison Corporation, Pasadena, Calif.

[21] Appl. No.: 846,328

[22] Filed: Apr. 30, 1997

[51] Int. Cl.[6] ..... B65B 35/50

[52] U.S. Cl. ..... 53/540; 53/557; 53/171; 53/157; 53/173; 53/154; 53/168; 53/237; 53/238; 53/564

[58] Field of Search ..... 53/152, 153, 154, 53/155, 157, 168, 171, 173, 237, 238, 240, 540, 557, 564, 579

[56] References Cited

U.S. PATENT DOCUMENTS

| | | | |
|---|---|---|---|
| 1,132,877 | 3/1915 | Petterson . | |
| 1,299,824 | 4/1919 | Cullen . | |
| 1,592,374 | 7/1926 | Lytle . | |
| 2,749,015 | 6/1956 | Pennebaker . | |
| 2,865,549 | 12/1958 | Inman . | |
| 3,019,886 | 2/1962 | Winkler et al. | 53/542 X |
| 3,041,803 | 7/1962 | Gamberini | 53/171 X |
| 3,199,763 | 8/1965 | Anderson . | |
| 3,203,154 | 8/1965 | Litchard | 53/564 X |
| 3,317,115 | 5/1967 | Conescu . | |
| 3,414,184 | 12/1968 | Loheed . | |
| 3,526,170 | 9/1970 | Oderman et al. | 53/540 X |
| 3,563,843 | 2/1971 | Wagers . | |
| 3,655,180 | 4/1972 | Holler | 53/540 X |
| 3,658,237 | 4/1972 | Engel . | |
| 3,746,593 | 7/1973 | Majewski . | |
| 3,910,485 | 10/1975 | Wandel . | |
| 3,954,165 | 5/1976 | Snyder | 53/152 X |
| 3,956,869 | 5/1976 | Slathar et al. | 53/240 X |
| 4,028,864 | 6/1977 | Bell | 53/540 X |
| 4,520,614 | 6/1985 | Aykut et al. | 53/540 |
| 4,574,565 | 3/1986 | Gambetti | 53/557 X |
| 4,578,929 | 4/1986 | Tisma | 53/579 X |
| 4,610,125 | 9/1986 | Meives et al. | 53/207 X |
| 4,809,482 | 3/1989 | Horton et al. | 53/541 X |
| 4,829,742 | 5/1989 | Romagnoli | 53/540 X |
| 4,927,322 | 5/1990 | Schweizer et al. | 53/152 X |
| 4,939,888 | 7/1990 | Katz et al. | 53/157 X |
| 5,018,334 | 5/1991 | Guttinger et al. | 53/540 X |
| 5,079,901 | 1/1992 | Kotsiopoulos | 53/238 X |
| 5,197,659 | 3/1993 | Vassiliou . | |
| 5,299,410 | 4/1994 | Freeman | 53/557 X |
| 5,358,595 | 10/1994 | Williams | 53/157 X |

*Primary Examiner*—Daniel B. Moon

*Attorney, Agent, or Firm*—Oppenheimer Wolff & Donnelly LLP

[57] ABSTRACT

The system involves the use of shallow boxes having an integral base and lid, with the lid being foldable down to close the box as part of the automated packaging of stacks of sheets of labels or other sheet material. The system involves one or more accumulators having buffering capability between sheet stackers and the cartoning equipment. The lids may be scored and subject to a pre-breaking step so that their three layer construction may be readily formed into boxes in the course of the packaging process.

22 Claims, 4 Drawing Sheets

EFFICIENT SHEET STACK PACKAGING TECHNIQUE

FIELD OF THE INVENTION

This invention relates to the loading of stacks of sheet material, such as sheets of labels, into boxes.

BACKGROUND OF THE INVENTION

At the present sheets of labels are loaded into two-part boxes manually. More specifically, in the loading of a conveyor line, four people are involved in the steps of picking up a stack of sheets, placing the stacks into box bases, putting a separate lid onto each box, and placing the boxes on the conveyor for plastic shrink wrapping of the loaded boxes, and loading the boxes into shipping containers.

SUMMARY OF THE INVENTION

Accordingly, a principal object of the present invention is to automate the packaging of stacks of sheet material such as label sheets, sheets of blank business cards, and similar sheet material.

One aspect of this invention involves the use of shallow boxes which have a base and an integral lid which may be folded down to close the box as part of the automated loading process.

In one specific illustrative system for implementing the invention, the automated system for packaging stacks of sheets may include the following:

(a) a sheet stacker for stacking predetermined numbers of individual sheets into a stack;

(b) an accumulator having successive spaces or slots for receiving stacks of sheets from the sheet stacker at an input point and for dispensing stacks of sheets at an output point with some of the slots being filled with sheets and others being empty, and moveable arrangements for varying the proportion of filled and empty slots so that the accumulator can continue to receive stacks of sheets if the output from the accumulator is delayed;

(c) a supply of scored unfolded blanks for forming the shallow boxes;

(d) a pre-breaking station for pre-folding the box blanks so that they may be readily formed into the final box configuration;

(e) a first adhesive application station for receiving boxes from the pre-breaking station and applying adhesive to selected base areas of the boxes;

(f) a first conveyor including a series of buckets shaped to receive the bases of the boxes for holding the bases while the base adhesive is setting, to permanently configure the bases of the boxes, while the foldable lids are open;

(g) a second conveyor for receiving the stacks of sheets from the accumulator;

(h) a cartoner coupled to the second conveyor for loading successive stacks of sheets into the open boxes with the bases of the boxes being in the buckets of the first conveyor;

(i) a second adhesive application station for applying adhesive to selected areas of the lids of the boxes after the stacks of sheets have been loaded into the boxes; and (j) a box closure station for folding the lids down to mate with the base of each said box and to enclose each of said stacks of sheets in a separate shallow box.

In accordance with another somewhat broader aspect of the invention, the system may include a supply of the unfolded shallow boxes with integral lids preferably prescored to fold easily, and a conveyor line with "buckets" to receive the bases of the shallow boxes. Adhesive is applied to the bases of the boxes, and they are depressed into the conveyor line buckets. Stacks of sheets are then loaded into the boxes. Adhesive is applied to the integral lid and it is folded down to complete the box.

In accordance with a feature of the invention, a special type of accumulator may be employed in the course of providing timely stacks of the sheet material for loading into the boxes. The accumulator or accumulators have a series of slots for receiving stacks of sheet material from a stacker. The sheet material is loaded into the accumulator at one or more input points and is delivered to an output point. The accumulator, in practice, has some slots which are filled with stacks of sheet material and some which are empty, with the slots being mounted on an endless belt or chain extending between the input point and the output point. This belt or chain is configured to permit varying the number of stacks of sheet material between the input and output points, so that the accumulator acts as a buffer between the sheet stacker apparatus and the conveyor leading to the cartoner box loading point.

Another aspect of the invention involves the possible use of two or more accumulators, feeding a single output conveyor, thereby accommodating stackers or presses operating at different speeds, associated with respectively different accumulators.

Advantages of the accumulator used in the system include: (1) the buffering feature discussed above, so that short time blockage of the loading operation is accommodated, for example; (2) inverting the stacks of sheet material which may be oriented upside-down by the stacker; (3) the acceptance of stacks of sheet material at different levels, as the stacks may be provided at different levels by the stackers; (4) accommodating presses or stackers running at different speeds, as noted above, when more than one accumulator is used; and (5) providing a "first-in, first-out" or "FIFO" mode of operation of the accumulator. Incidentally, this FIFO mode of operation is desirable, as there is some tendency for stacks of label sheets to curl if they are unconstrained, under certain ambient conditions.

It may also be noted that the use of boxes having integral bases and lids simplifies the automation process in closing the lid on filled boxes, as compared with more complex arrangements which would be required for mounting separate lids onto separate filled box bases.

An additional advantage involves the reduction in direct labor costs, and the resultant substantial reduction in the loading cost per box.

Other objects, features and advantages of the invention will become apparent from a consideration of the following detailed description and the accompanying drawings.

BRIEF DESCRIPTION OF THE DRAWINGS

FIG. 1—1 is an enlarged schematic detail of the lower ends of one of the accumulators of FIG. 1;

DETAILED DESCRIPTION OF THE PREFERRED EMBODIMENTS

Figure 1:
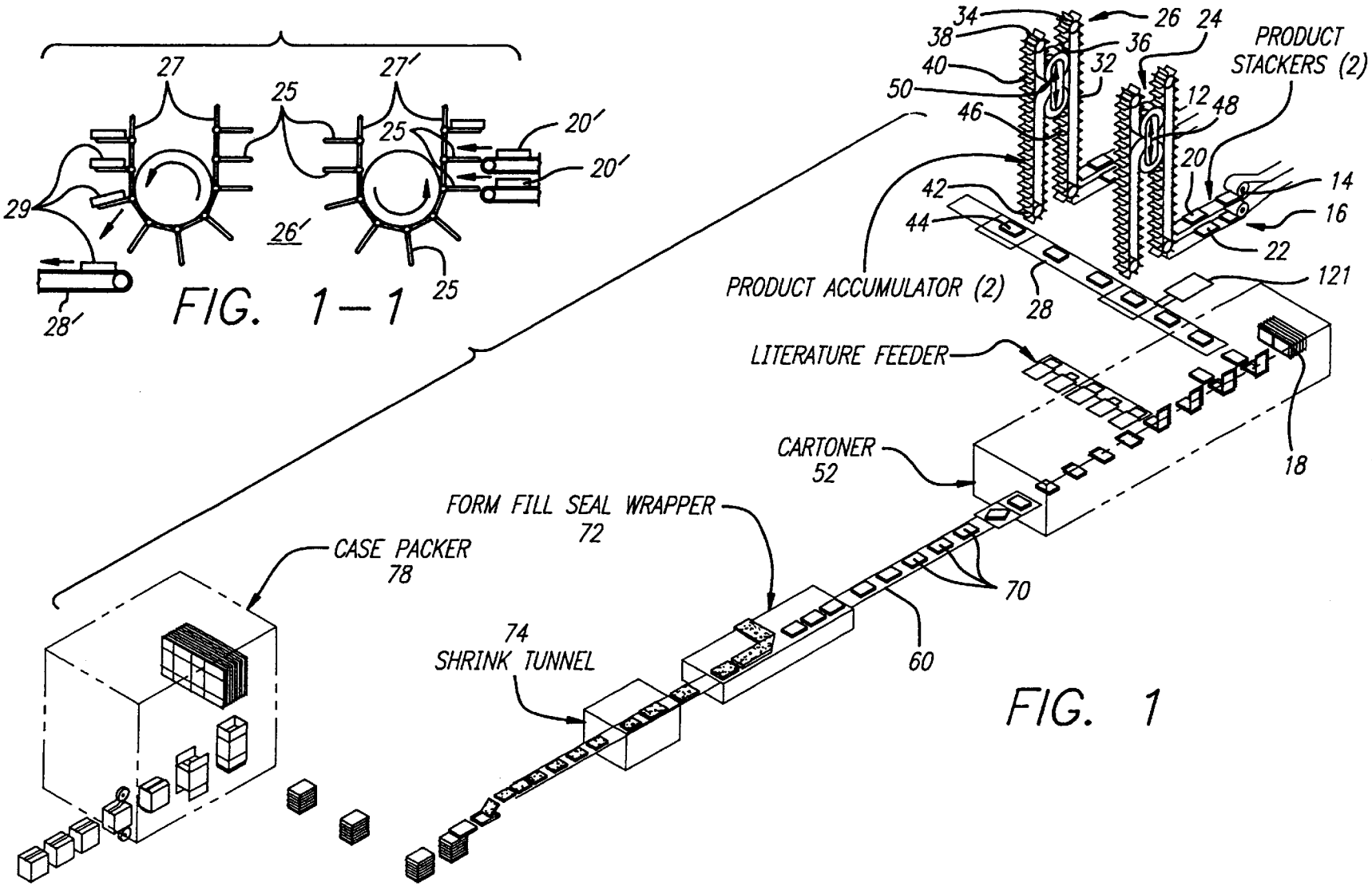
FIG. 1 is a diagrammatic view of a complete system illustrating the principles of the invention.
Figure 4:
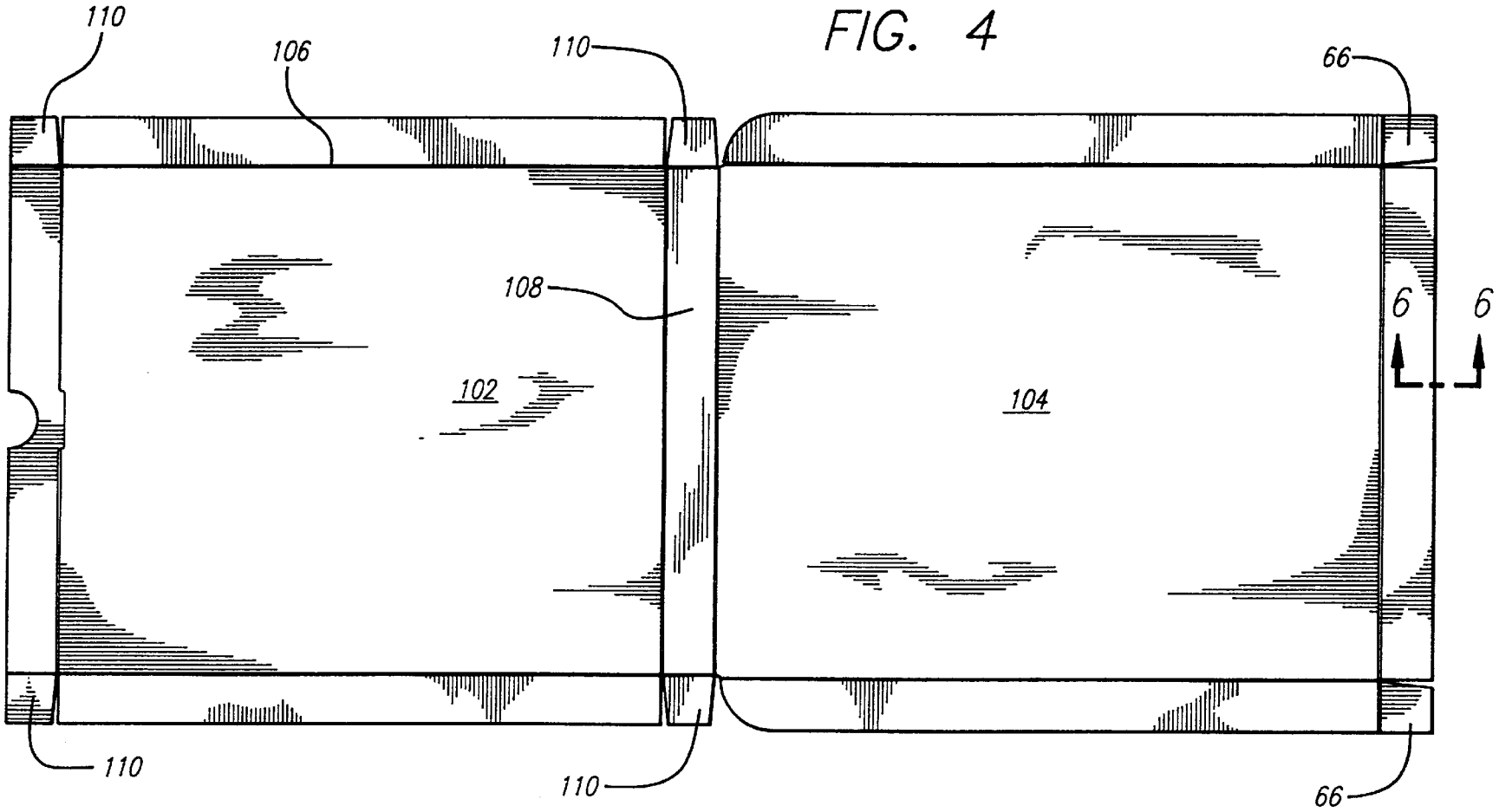
FIG. 4 is a plan view of a scored blank for forming the shallow boxes having integral bases and lids used in the system of FIG. 1.

Referring more particularly to the drawings, FIG. 1 is an over-all system view illustrating the principles of the present invention. In considering system of FIG. 1, label sheets to be packaged arrive at points 12 and 14 at the input to two stackers, one of which is shown at reference numeral 16. Box or carton blanks, of the type shown in FIG. 4 are stacked up at reference numeral 18 in FIG. 1. Stacks of paper 20 and 22 are supplied from the stacker 16 at different levels to the inputs of accumulator 24, with a similar series of stacks of paper or label sheets being supplied to the second accumulator 26.

The stacks of paper are held in slots between plates 25 (see, FIG. 1—1) extending outwardly from the accumulators 24 and 26. They are carried from the input points where the stacks of label sheets or other stack material is supplied from the stackers such as stacker 16 to the output point from the accumulator where the stacks of sheets are deposited on the conveyor 28. The stacks of sheets from the conveyor 24 maybe alternated with the stacks of sheets from the accumulator 26, as shown in FIG. 1. Alternatively, the conveyor 28 may receive stacks of sheets only from one or the other of the two accumulators, and may receive more from one than the other in cases where the stackers, or the presses supplying sheet material to the stackers, work at different speeds. In addition, small stacks of sheet materials of different types may be stacked up on top of one-another to form a mixed full stack of different sheets, such as label sheets of different size labels, for loading into a single box.

Stackers of the type shown at reference numeral 16 in FIG. 1 are available from Gannicott, Ltd., 111 Finchdene Square, Unit 7, Scarborough, Ontario, Canada MTX 1A7; and accumulators such as those shown at reference numerals 24 and 26 are available from Rolco International, 2424 Progress Court, Neenah, Wis., 54957-0385.

Concerning specific details of the accumulators 24 and 26, reference will be made to accumulator 26 for convenience. From the point where the stacks of sheets are received at the right hand column 32 of accumulator 26, the endless belt or chain support upon which the stack carrying vanes, forming slots, are mounted, passes up over the top 34 of the right hand side of the accumulator down through a loop 36 which includes a series of slots which are filled with stacks of sheet material, up to the top 38 of the left hand side of accumulator 26 and on down the lefthand side 40 of the accumulator to the output point 42 where stacks of sheet material such as the stack 44 are deposited on conveyor 28.

The inner, lower loop 46 of the flexible accumulator belt or chain is of course empty of stacks of sheet material as it extends through the loop and back to the input point on side 32 of the accumulator 26. As indicated by the two-headed arrow 48, the loops 36 and 46 may be moved upwardly or downwardly as the assembly 50 is shifted vertically in its position. This capability permits buffering of the rate of flow from the stackers relative to the rate of pickup of stacks from the accumulator onto the conveyor belt 28. Thus, if the conveyor belt 28 stops because of some problem, stacks of paper may continue to be loaded onto the right hand side of the accumulator, and the assembly 50 with its idler wheels may be moved downwardly so that the loop 36 carrying filled slots is increased in size, while the loop 46 which is empty of stacks of material becomes shorter. Of course, at this time, the lefthand side 40 of the accumulator 26 is maintained stationary, with no additional stacks being off-loaded to the conveyor 28. The showing of FIG. 1 is purely diagrammatic, and the assembly 50 would in practice be mounted on rails to readily move up and down, in accordance with the accumulator product available from Rolco International, as noted above.

Of course, the mode of operation of the accumulator 24 is substantially the same as that described hereinabove for accumulator 26, with the proviso that each of thee two accumulators may be operated at different speeds, for example, to accommodate different output rates from the product stackers.

FIG. 1—1 is an enlarged diagramatic showing of the lower end of either of the accumulators 24 or 26. In FIG. 1—1, the stacks of paper or label sheets 20' and 22' are being loaded into slots between successive vanes 25 secured to the flexible belt or chain 27. To the left in FIG. 1—1, the stacks of sheet material designated by reference numeral 29 are being off loaded onto conveyor 28'. The vanes 25 in the region 46' of FIG. 1—1 are empty of stacks of sheet material, with the loop 46' forming part of the buffering structure discussed hereinabove.

Figure 2:
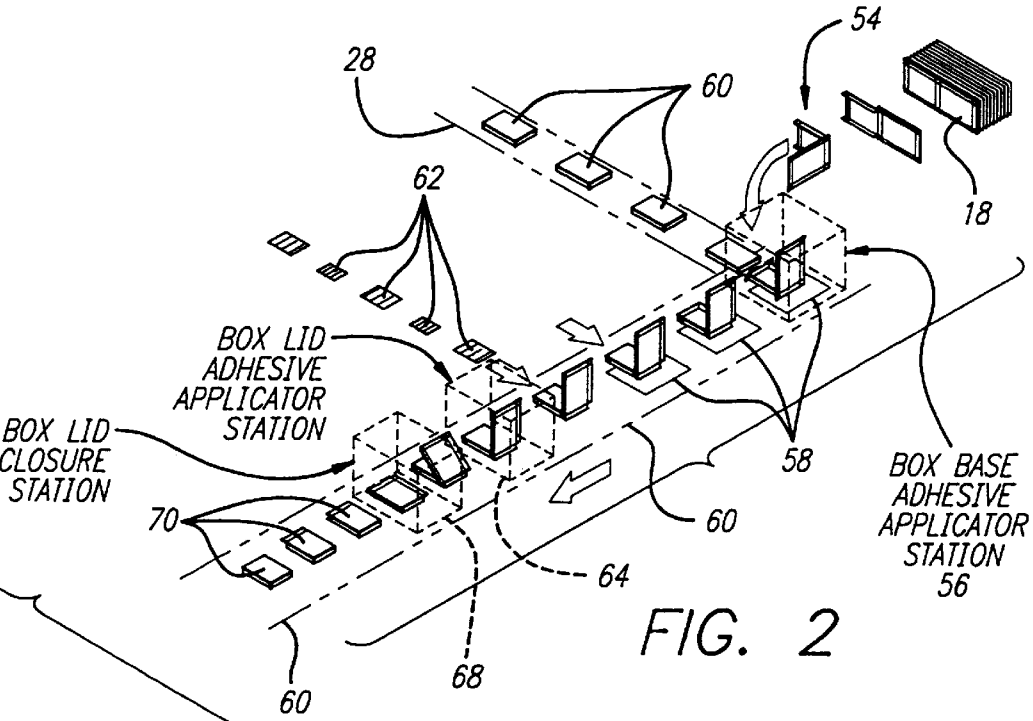
FIG. 2 is a more complete showing of the cartoning portion of the system of FIG. 1.

The conveyor 28 transports the stacks of label sheets or other paper products to the cartoner 52. The nature of the cartoner 52 is shown in greater detail in FIG. 2. At the righthand end of FIG. 2 is shown the stack of box blanks 18, such as those shown in FIG. 4 of the drawings. The steps of pre-breaking or partially forming the boxes is indicated at reference numeral 54, and the next step is the application of hot melt adhesive at the box base adhesive applicator station 56. From this station, the bases of the boxes are placed down into recesses or "buckets" 58 to hold the bases of the boxes firmly in position, while the adhesive sets. A mandrel may be employed to push the boxes down into the buckets or box retaining stations, and vacuum hold down arrangements may also be used.

Stacks of sheet material such as the stacks 60 are supplied to the cartoner 52 by the conveyor belt 28. The cartoner, such as that available from Langen Packaging, Inc. of 6154 Kestral Road, Mississauga, Ontario, Canada, L5T 1Z2, includes a loading apparatus which receives the stacks of labels, and then has a pair of doors which open like bomb bay doors to drop the stacks of sheets of paper 60 into the open boxes which are recessed into the buckets 58. Other arrangements for loading the stacks of paper into the boxes could also be employed; for specific example the conveyor 28 could have an end section with an extending nose, which retracts, to deposit the stacks of paper into the boxes.

Following the loading of the stacks of sheets of paper into the boxes, the boxes move along the conveyor line 60. At an adjacent station, additional material such as instructions or advertising 62 may be loaded into the open boxes. At station 64, hot melt is applied to tabs 66 (see FIG. 4) of the box lid, and the lid sides are folded into their final assembled position. At the next station 68, the lids are folded down to the closed position, as indicated by the boxes 70, in FIG. 2.

Returning now to FIG. 1, the closed and loaded boxes are then enclosed in plastic sheet material at the form fill seal wrapper station 72, and the shrink wrap step is completed in the shrink tunnel 74 where the plastic wrap is heated so that it forms a tight fit around the loaded boxes.

Incidentally, the hot melt glue dispensers are available from Nordson Corporation, 11475 Lakefield Drive, Guluth, Ga., 30155. In addition, the shrink film wrapper and the shrink tunnel are available from the Shanklin Corporation, 100 Westford Road, Ayer, Mass., 01432.

From the shrink tunnel 74, the loaded and sealed boxes are supplied to the case packer 78, which assembles boxes of the packaged sheet material into protective outer boxes, and prepares them for shipment. One source for the case packer is FMS Manufacturing Company, 7020 W. Sunnyview Avenue, Visalia, Calif., 93291.

Figure 3:
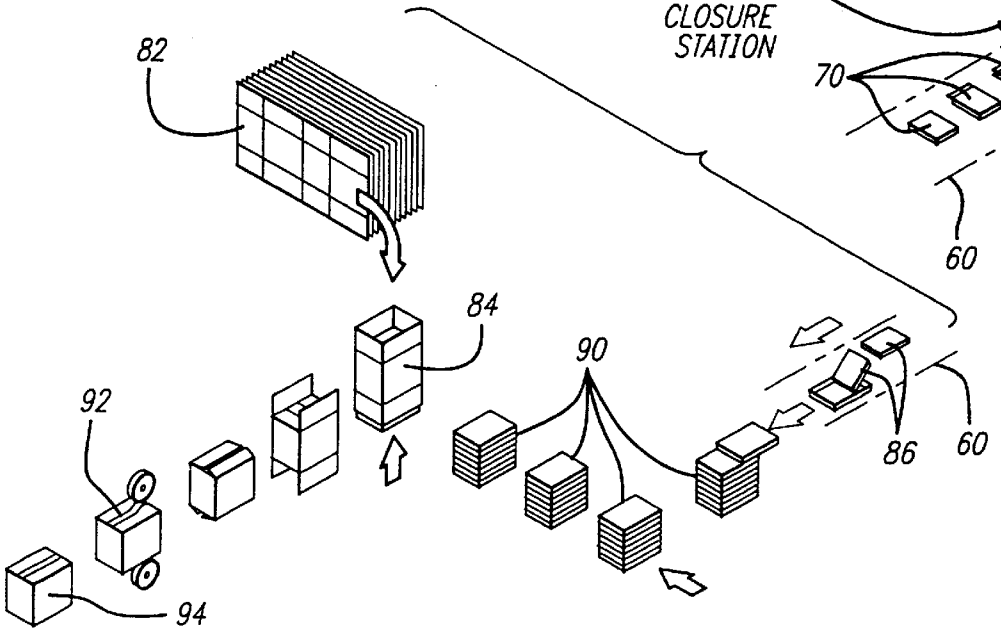
FIG. 3 is a more complete showing of the case packing portion of the system of FIG. 1.

FIG. 3 is a more detailed showing of the packing steps. Specifically, the outer cartons 82 are formed into large boxes 84, the loaded boxes 86 from the conveyor 60 are stacked into stacks of boxes 90, and the outer cartons are assembled over these stacks and are sealed by tape 92 to form the final shipping packages 94, Turning now to FIG. 4 of the drawings, the bottom 102 of the box is formed integrally with the top 104 to permit easier packing and immediate closing of the boxes, as described hereinabove. The boxes are scored as indicated, for example, at score lines 106, 108, and other score lines shown within the perimeter of the box blank. The box bottom 102 has four tabs 110, to which hot melt adhesive is applied (see, station 56 in FIG. 2) prior to final folding of the base and insertion into the buckets 58 as discussed in connection with FIG. 2 of the drawings. The lid 104 has two glue tabs 66 to which the hot melt adhesive is applied at station 68 of FIG. 2 before the top 104 is folded into its final configuration and closed.

Figure 5:
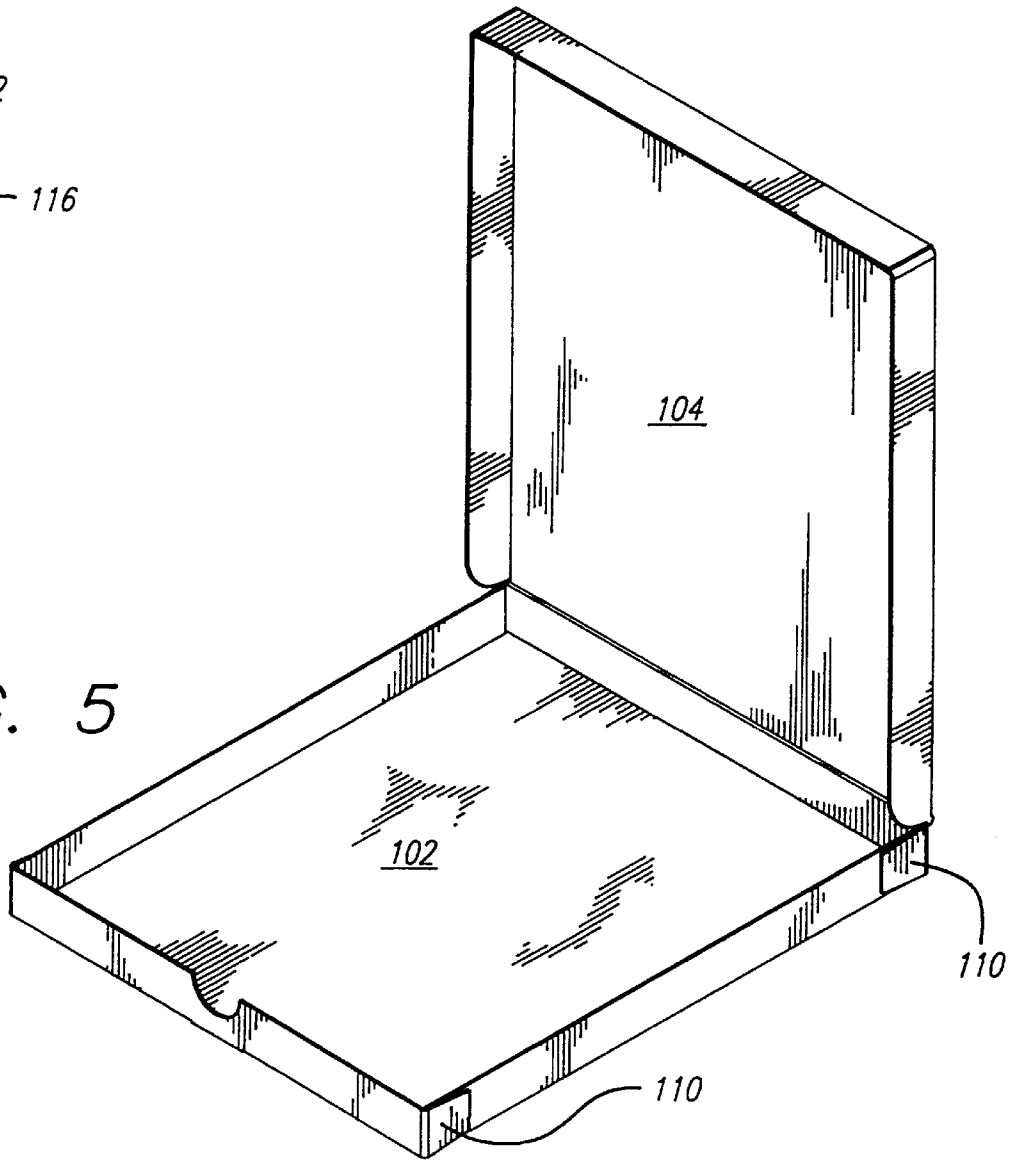
FIG. 5 is a perspective view of one of the shallow boxes having integral bases and lids.

Referring now to FIG. 5 of the drawings, the configuration of the box in its fully formed state it is shown, with the tabs 110 external to the base of the box being shown holding the base together. However, the tabs 66 for the top 104, are not shown, as they are concealed in the particular perspective view of FIG. 5.

Figure 6:
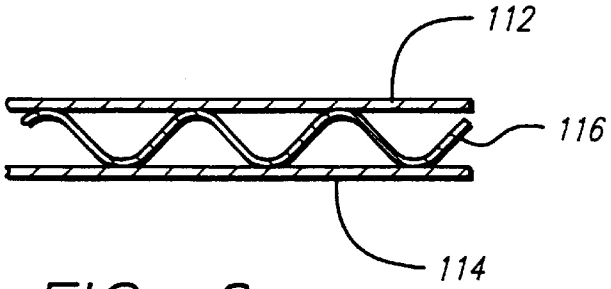
FIG. 6 is a detail showing the layered construction of the shallow boxes.

FIG. 6 is a cross sectional view taken along lines 6—6 of FIG. 4, and shows one possible layered construction of the box. Specifically, the box walls may be less than 1/16 of an inch thick, and may include three layers, an outer layer 112, an inner layer 114, and an intermediate corrugated layer 116. With this construction, scoring and pre-breaking functions are preferably involved to facilitate the steps of forming, loading and closing the boxes, so that the resultant box will maintain its fully formed configuration, without any of the sides bowing out or otherwise departing from the desired rectilinear configuration. It may also be noted that the boxes may be formed of plastic (corrugated, or non-corrugated), or of solid fiber board. In addition, instead of hot melt glue, the boxes may be held together using water based cold glue, pressure sensitive adhesive or staples; or for plastic boxes, R-F sealing, or sonic welding, or heat sealing may be employed.

It is further noted that it is often desirable to insert additional sheet material into the product boxes, and this may be accomplished by the product stacker 121, see FIG. 1. This may be in the nature of samples of new products, or the like. The product stacker 121 may be obtained from Multifeeder Technology, 2905 Country Drive, Suite 100, Little Canada, Minn., 55117.

Concerning dimensions, the boxes are normally intended to contain sheets of labels having a nominal size of 8 ½ inches by 11 inches, or A4 paper, and accordingly, the boxes are less than 9 inches by 12 inches in size, and normally less than 1 inch in height. However, departures from these dimensions to accommodate special needs are to be expected, with dimensions from 3" by 5" up to 11" by 17", for specific examples.

In addition to the sources of equipment identified in the foregoing body of this specification, additional equipment for use in the system described hereinabove may be obtained from the following companies, with the indicated equipment being listed with the companies:

| | |
|---|---|
| 1. ELECTRICAL CONTROL HARDWARE | Allen Bradley Company<br>1201 S. Second Street<br>Milwaukee, WI 53204 |
| 2. LABELLER | Eagle Automation<br>2804 West LeFevre<br>Sterling, IL 61081 |
| 3. CODE DATER | Diagraph Corporation<br>3401 Rider Trail South<br>Earth City, MO 63045 |
| 4. LABELLER | Avery Dennison Corporation<br>7722 Dungan Road<br>Philadelphia, PA 19111 |

In the foregoing detailed description, specific equipments and arrangements have been set forth for purposes of illustration. However, it is to be understood that comparable equipment performing substantially the same functions may be substituted for the equipments which have been identified and that different sheet products may be packaged. Thus, by way of example and not of limitation, the stacks of sheet material may be fan-folded material, instead of stacks of separate individual sheets. When fan folded stacks of sheet material are being handled, apparatus for supplying successive stacks of fan folded sheets are substituted for the stackers at the input to the accumulators. Accordingly, the present invention is not limited precisely to the arrangements shown, and to the specific equipments specified.

What is claimed is:

1. A system for the loading of stacks of sheet material into shallow product boxes having predetermined dimensions on the order of 9 inches by 12 inches by 1 inch or less, said boxes having integral lids which may be folded down to close the boxes; said system comprising:

(a) a sheet stacker for stacking predetermined numbers of individual sheets into a stack;

(b) a variable capacity accumulator having a continuous loop bearing successive slots for receiving stacks of sheets from said sheet stacker at an input point and for dispensing stacks of sheets at an output point with some of said slots being filled with sheets and others being empty, and moveable arrangements for varying the proportion of filled and empty slots so that said accumulator can continue to receive stacks of sheets if the output from the accumulator is delayed; said accumulator including means for moving said loop and associated slots at said input point when said loop at said output point is stationary, and means for moving said loop and associated slots at said output point when said loop at said input point is stationary (c) a supply of scored unfolded blanks for forming said shallow boxes having said predetermined dimensions;

(d) a station for pre-breaking and pre-folding said blanks so that they may be readily formed into the final box configuration;

(e) an adhesive application station for receiving boxes from said pre-breaking station and applying adhesive to selected areas of said boxes;

(f) a first conveyor including a series of buckets shaped to receive the bases of said boxes for holding said bases of said boxes while the base adhesive is setting, to permanently configure the bases of said boxes, while the foldable lids are open;

(g) a second conveyor for receiving said stacks of sheets from said accumulator;

(h) a cartoner coupled to said second conveyor for loading successive stacks of sheets into the open boxes with the bases of the boxes being in the buckets of said first conveyor; and (i) a box closure station for folding said lids down to mate with the base of each said box and to enclose each of said stacks of sheets in a separate shallow box of said predetermined dimensions.

2. A system as defined in claim 1 wherein a station is provided for loading additional sheet material into said boxes before the lid is closed.

3. A system as defined in claim 1 wherein said stacker supplies stacks of sheets to said accumulator at different locations along said accumulator.

4. A system as defined in claim 1 wherein a second stacker and a second accumulator are provided, and wherein said stacks of sheets are loaded into said boxes from both said first and said second accumulator by said second conveyor and said cartoner.

5. A system as defined in claim 1 further including a station for applying a plastic wrap to the filled and closed boxes, and a heat shrink tunnel for shrinking said plastic wrap onto said product boxes.

6. A system for the loading of stacks of sheet material into shallow product boxes having predetermined dimensions on the order of 9 inches by 12 inches by 1 inch or less, said boxes having integral lids which may be folded down to close the boxes, said system comprising:

(a) apparatus for providing stacks of sheet material including a predetermined number of sheets;

(b) a variable capacity accumulator including a continuous loop for holding successive stacks of sheets received from the apparatus of paragraph (a), said accumulator having the capability to continue to receive stacks of sheets if the output from the accumulator is delayed; said accumulator including means for moving said loop and associated slots at an input point when said loop at an output point is stationary means for moving said loop and associated slots at said output point when said loop at said input point is stationary, and for moving said loop at both the input and output points concurrently;

(c) a supply of scored unfolded blanks for forming said shallow boxes having said predetermined dimensions;

(d) a pre-breaking station for pre-folding said blanks so that they may be readily formed into the final box configuration;

(e) an adhesive application station for receiving boxes from said pre-breaking station and applying adhesive to selected areas of said boxes;

(f) a first conveyor including a series of buckets shaped to receive the bases of said boxes for holding said bases of said boxes while the base adhesive is setting, to permanently configure the bases of said boxes, while the foldable lids are open;

(g) a second conveyor for receiving said stacks of sheets from said accumulator;

(h) a cartoner coupled to said second conveyor for loading successive stacks of sheets into the open boxes with the bases of the boxes being in the buckets of said first conveyor; and (i) a box closure station for folding said lids down to mate with the base of each said box and to enclose each of said stacks of sheets in a separate shallow box having said predetermined dimensions.

7. A system as defined in claim 6 wherein said stacker supplies stacks of sheets to said accumulator at different locations along said accumulator.

8. A system as defined in claim 6 wherein a second stacker and a second accumulator are provided, and wherein said stacks of sheet material are loaded into said boxes from both said first and said second accumulator by said second conveyor and said cartoner.

9. A system as defined in claim 6 further comprising a case packer for assembling the loaded boxes into cases, each including a plurality of boxes.

10. A system for the loading of stacks of sheet material into shallow product boxes having predetermined dimensions in the order of 9 inches by 12 inches by 1 inch or less, said boxes having integral lids which may be folded down to close the boxes, said system comprising:

a sheet stacker for stacking predetermined numbers of individual sheets into a stack;

a variable capacity accumulator having a continuous loop bearing successive slots for receiving stacks of sheets from said sheet stacker at an input point and for dispensing stacks of sheets at an output point, with some of said slots being filled with sheets and others being empty, and movable arrangements for varying the proportion of filled and empty slots so that said accumulator can continue to receive stacks of sheets if the output from the accumulator is delayed; said accumulator including means for moving said loop and associated slots at said input point when said loop at said output point is stationary, and means for moving said loop and associated slots at said output point when said loop at said input point is stationary;

a supply of scored unfolded blanks for forming said shallow boxes having said predetermined dimensions;

a station for pre-breaking and pre-folding said blanks so that they may be readily formed into the final box configuration;

an adhesive application station for receiving boxes from said pre-breaking station and applying adhesive to selected areas of said boxes;

a first conveyor including a series of buckets shaped to receive the bases of said boxes for holding said bases of said boxes while the base adhesive is setting, to permanently configure the bases of said boxes, while the foldable lids are open;

a second conveyor for receiving said stacks of sheets from said accumulator;

a cartoner coupled to said second conveyor for loading successive stacks of sheets into the open boxes with the bases of the boxes being in the buckets of said first conveyor; and a box closure station for folding said lids down to mate with the base of each said box and to enclose each of said stacks of sheets in a separate shallow box of said predetermined dimensions.

11. A system as defined in claim 10 wherein a station is provided for loading additional sheet material into said boxes before the lid is closed.

12. A system as defined in claim 10 further including a station for applying a plastic wrap to the filled and closed boxes, and a heat shrink tunnel for shrinking said plastic wrap onto said product boxes.

13. A system as defined in claim 10 wherein said means for forming boxes includes an adhesive applicator which applies hot to melt adhesive to the bases and applies hot melt adhesive to the lids of said boxes.

14. A system as defined in claim 10 wherein said boxes are formed of an inner layer, an outer layer, and corrugated intermediate spacer layer.

15. A system as defined in claim 10 wherein said boxes are formed of stock which is 1/16 inch or less inches thick.

16. A versatile system for loading stacks of sheet material into shallow product boxes having predetermined dimensions equal to or less than 9 inches by 12 inches by one inch, said boxes having integral lids which may be folded down to close the boxes, said system comprising:

a plurality of sheet stackers;

a product conveyor;

first and second variable capacity accumulators, each having a continuous loop following a closed path and bearing slots for receiving stacks of sheets;

said first accumulator having first and second input points and an output point; and said second accumulator having at least one input point and an output point;

a first one of said stackers being coupled to supply stacks of said sheet material to said first input point of said first accumulator;

a second one of said stackers being coupled to supply stacks of said sheet material to said second input point of said first accumulator;

a third one of said stackers being coupled to supply stacks of said sheet material to said second accumulator;

said output points of said first and second accumulators being coupled to deposit stacks of sheet material onto said product conveyor;

a supply of scored unfolded blanks for forming said shallow boxes having said predetermined dimensions;

a station for pre-breaking and pre-folding said blanks so that they may be readily formed into the final box configuration;

an adhesive application station for receiving boxes from said pre-breaking station and applying adhesive to said boxes;

a carton conveyor including a series of buckets shaped to receive the bases of said boxes for holding said bases of said boxes while the base adhesive is setting, to permanently configure the bases of said boxes, while the foldable lids are open;

said product conveyor being coupled to deposit said stacks of sheets into said boxes on said carton conveyor, with the bases of the boxes being in the buckets of said first conveyor; and a box closure station for folding said lids down to mate with the base of each said box and to enclose each of said stacks of sheets in a separate shallow box of said predetermined dimensions.

17. A system for the loading of stacks of sheet material into shallow product boxes having predetermined dimensions on the order of 9 inches by 12 inches by 1 inch or less, said boxes having bases and integral lids; said system comprising:

(a) apparatus for providing stacks of sheet material including a predetermined number of sheets;

(b) a variable capacity accumulator having successive spaces or slots for receiving stacks of sheets from said sheet stacker at an input point and for dispensing stacks of sheets at an output point with some of said slots being filled with sheets and others being empty, and moveable arrangements for varying the proportion of filled and empty slots so that said accumulator can continue to receive stacks of sheets if the output from the accumulator is delayed; said accumulator including means for moving said loop and associated slots at said input point when said loop at said output point is stationary, and means for moving said loop and associated slots at said output point when said loop at said input point is stationary;

(c) a supply of scored unfolded blanks for forming said shallow boxes of said predetermined dimensions, including integral lids for said boxes;

(d) means for forming said blanks into boxes;

(e) a first conveyor including a series of box retaining stations shaped to receive the bases of said boxes with the lids open;

(f) a second conveyor for receiving said stacks of sheet material from said accumulator;

(g) a cartoner coupled to said second conveyor for loading successive stacks of sheet material into the open boxes with the sheets mounted flat in the bottom of said shallow boxes; and (h) a box closure station for closing the integral lids for said boxes to mate with the base of each said box and to enclose each of said stacks of sheet material in a separate shallow box.

18. A system as defined in claim 17 wherein said accumulator includes a continuous flexible support for said spaces or slots, extending from said input to said output.

19. A system as defined in claim 18 wherein said continuous flexible support includes two loops, one for slots filled with stacks of sheet material and one having empty slots, said loops having a single support movable in one direction to increase the number of filled slots and decrease the number of empty slots, or movable in the opposite direction to reduce the number of filled slots and increase the number of empty slots, thereby changing the number of stacks of sheet material held in said accumulator, to buffer the flow of stacks of sheet material between said input point and said second conveyor.

20. A system as defined in claim 17 wherein said supply of blanks are for boxes having integral bases and lids, and wherein said box closure station includes arrangements for folding down the lids to close the boxes.

21. A system as defined in claim 17 wherein a second accumulator is provided, and wherein said stacks of sheet material are loaded into said boxes from both the first and said second accumulator by said second conveyor and said cartoner.

22. A system as defined in claim 17 wherein said apparatus for supplying stacks of sheet material, supplies said stacks of sheet material to said accumulator at different locations along said accumulator.

* * * * *